US007245844B2

(12) United States Patent
de Jong et al.

(10) Patent No.: US 7,245,844 B2
(45) Date of Patent: Jul. 17, 2007

(54) PRINTING SYSTEM

(75) Inventors: Jeremy C. de Jong, Webster, NY (US); Bryan J. Roof, Fairport, NY (US); Anthony S. Condello, Webster, NY (US)

(73) Assignee: Xerox Corporation, Stamford, CT (US)

( * ) Notice: Subject to any disclaimer, the term of this patent is extended or adjusted under 35 U.S.C. 154(b) by 309 days.

(21) Appl. No.: 11/094,864

(22) Filed: Mar. 31, 2005

(65) Prior Publication Data

US 2006/0222393 A1 Oct. 5, 2006

(51) Int. Cl.
*G03G 15/20* (2006.01)

(52) U.S. Cl. ..... 399/69

(58) Field of Classification Search ..... 399/69, 399/299, 306, 309, 320, 328, 330, 364, 401, 399/107

See application file for complete search history.

(56) References Cited

U.S. PATENT DOCUMENTS

| | | | | |
|---|---|---|---|---|
| 4,579,466 | A | 4/1986 | Sato | |
| 4,587,532 | A | 5/1986 | Asano | |
| 4,591,884 | A * | 5/1986 | Miyamoto et al. | 347/153 |
| 4,836,119 | A | 6/1989 | Siraco | |
| 4,972,236 | A * | 11/1990 | Hasegawa | 399/16 |
| 5,080,340 | A | 1/1992 | Hacknauer | |
| 5,095,342 | A | 3/1992 | Farrell | |
| 5,159,395 | A | 10/1992 | Farrell | |
| 5,208,640 | A | 5/1993 | Horie | |
| 5,258,809 | A * | 11/1993 | Wiedemer | 399/112 |
| 5,272,511 | A | 12/1993 | Conrad | |
| 5,326,093 | A | 7/1994 | Sollitt | |
| 5,389,969 | A | 2/1995 | Suzuki | |
| 5,435,544 | A | 7/1995 | Mandel | |
| 5,473,419 | A | 12/1995 | Russel | |
| 5,504,568 | A | 4/1996 | Saraswat | |

(Continued)

FOREIGN PATENT DOCUMENTS

| | | | |
|---|---|---|---|
| JP | 07295431 | A * | 11/1995 |
| JP | 2001265158 | A * | 9/2001 |

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—Robert Beatty
(74) *Attorney, Agent, or Firm*—Fay Sharpe LLP; Eugene O. Palazzo

(57) ABSTRACT

A printing system includes first and second marking engines. First and second fusers are associated with the marking engines, respectively. The printing system has a first mode of operation in which print media is fused by both fusers and a second mode of operation in which at least a portion of the print media is fused by the second fuser, which portion has not been previously fused by the first fuser. The second fuser has first and second fuser operating modes when the printing system is in the first and second modes of operation, respectively. The second fuser applies a first energy input to the print media in the first fuser operating mode and a second energy input, different from the first energy input, to the print media in the second fuser operating mode.

21 Claims, 5 Drawing Sheets

U.S. PATENT DOCUMENTS 5,519,484 A * 5/1996 Kumagai ..... 399/364
5,525,031 A 6/1996 Fox
5,557,367 A 9/1996 Yang
5,568,246 A 10/1996 Keller
5,570,172 A 10/1996 Acquaviva
5,596,416 A 1/1997 Barry
5,598,257 A * 1/1997 Keller et al. ..... 399/364
5,629,762 A 5/1997 Mahoney
5,652,949 A * 7/1997 Ogawa et al. ..... 399/69
5,710,968 A 1/1998 Clark
5,778,377 A 7/1998 Marlin
5,884,910 A 3/1999 Mandel
5,995,721 A 11/1999 Rourke
6,059,284 A 5/2000 Wolf
6,101,364 A * 8/2000 Boehmer et al. ..... 399/361
6,125,248 A 9/2000 Moser
6,241,242 B1 6/2001 Munro
6,297,886 B1 10/2001 Cornell
6,384,918 B1 5/2002 Hubble, III
6,450,711 B1 9/2002 Conrow
6,476,376 B1 11/2002 Biegelsen
6,476,923 B1 11/2002 Cornell
6,493,098 B1 12/2002 Cornell
6,537,910 B1 3/2003 Burke
6,550,762 B2 4/2003 Stoll
6,554,276 B2 4/2003 Jackson
6,577,925 B1 6/2003 Fromherz
6,607,320 B2 8/2003 Bobrow
6,608,988 B2 8/2003 Conrow
6,612,566 B2 9/2003 Stoll
6,621,576 B2 9/2003 Tandon
6,633,382 B2 10/2003 Hubble, III
6,639,669 B2 10/2003 Hubble, III
6,728,497 B2 * 4/2004 Masuda et al. ..... 399/45
6,795,661 B2 * 9/2004 Kanesawa et al. ..... 399/69
6,819,906 B1 11/2004 Herrmann
7,136,616 B2 * 11/2006 Mandel et al. ..... 399/388
2002/0078012 A1 6/2002 Ryan
2002/0103559 A1 8/2002 Gartstein
2003/0077095 A1 4/2003 Conrow
2004/0085561 A1 5/2004 Fromherz
2004/0085562 A1 5/2004 Fromherz
2004/0088207 A1 5/2004 Fromherz
2004/0150156 A1 8/2004 Fromherz
2004/0150158 A1 8/2004 Biegelsen
2004/0153983 A1 8/2004 McMillan
2004/0216002 A1 10/2004 Fromherz
2004/0225391 A1 11/2004 Fromherz
2004/0226394 A1 11/2004 Fromherz
2006/0067756 A1 * 3/2006 Anderson et al. ..... 399/341
2006/0067757 A1 * 3/2006 Anderson et al. ..... 399/341
2006/0115306 A1 * 6/2006 Lofthus et al. ..... 399/341

OTHER PUBLICATIONS

Desmond Fretz, "Cluster Printing Solution Announced", Today at Xerox (TAX), No. 1129, Aug. 3, 2001.
U.S. Appl. No. 10/761,522, filed Jan. 21, 2004, Mandel et al.
U.S. Appl. No. 10/785,211, filed Feb. 24, 2004, Lofthus et al.
U.S. Appl. No. 10/860,195, filed Aug. 23, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/917,768, filed Aug. 13, 2004, Lofthus et al.
U.S. Appl. No. 10/924,106, filed Aug. 23, 2004, Lofthus et al.
U.S. Appl. No. 10/924,113, filed Aug. 23, 2004, deJong et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/001,890, filed Dec. 2, 2004, Lofthus et al.
U.S. Appl. No. 11/002,528, filed Dec. 2, 2004, Lofthus et al.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.

* cited by examiner

PRINTING SYSTEM

CROSS REFERENCE TO RELATED PATENTS AND APPLICATIONS

The following applications, the disclosures of each being totally incorporated herein by reference are mentioned:

U.S. Provisional Application Ser. No. 60/631,651, filed Nov. 30, 2004, entitled "TIGHTLY INTEGRATED PARALLEL PRINTING ARCHITECTURE MAKING USE OF COMBINED COLOR AND MONOCHROME ENGINES," by David G. Anderson, et al.;

U.S. Provisional Application Ser. No. 60/631,656, filed Nov. 30, 2004, entitled "MULTI-PURPOSE MEDIA TRANSPORT HAVING INTEGRAL IMAGE QUALITY SENSING CAPABILITY," by Steven R. Moore;

U.S. Provisional Patent Application Ser. No. 60/631,918, filed Nov. 30, 2004, entitled "PRINTING SYSTEM WITH MULTIPLE OPERATIONS FOR FINAL APPEARANCE AND PERMANENCE," by David G. Anderson et al.;

U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE," by David G. Anderson et al.;

U.S. application Ser. No. 10/761,522, filed Jan. 21, 2004, entitled "HIGH RATE PRINT MERGING AND FINISHING SYSTEM FOR PARALLEL PRINTING," by Barry P. Mandel, et al.;

U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. application Ser. No. 10/860,195, filed Aug. 23, 2004, entitled "UNIVERSAL FLEXIBLE PLURAL PRINTER TO PLURAL FINISHER SHEET INTEGRATION SYSTEM," by Robert M. Lofthus, et al.;

U.S. application Ser. No. 10/881,619, filed Jun. 30, 2004, entitled "FLEXIBLE PAPER PATH USING MULTIDIRECTIONAL PATH MODULES," by Daniel G. Bobrow.;

U.S. application Ser. No. 10/917,676, filed Aug. 13, 2004, entitled "MULTIPLE OBJECT SOURCES CONTROLLED AND/OR SELECTED BASED ON A COMMON SENSOR," by Robert M. Lofthus, et al.;

U.S. application Ser. No. 10/917,768, filed Aug. 13, 2004, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. application Ser. No. 10/924,106, filed Aug. 23, 2004, for PRINTING SYSTEM WITH HORIZONTAL HIGHWAY AND SINGLE PASS DUPLEX by Lofthus, et al.;

U.S. application Ser. No. 10/924,113, filed Aug. 23, 2004, entitled "PRINTING SYSTEM WITH INVERTER DISPOSED FOR MEDIA VELOCITY BUFFERING AND REGISTRATION," by Joannes N. M. deJong, et al.;

U.S. application Ser. No. 10/924,458, filed Aug. 23, 2004 for PRINT SEQUENCE SCHEDULING FOR RELIABILITY by Robert M. Lofthus, et al.;

U.S. patent application Ser. No. 10/924,459, filed Aug. 23, 2004, entitled "PARALLEL PRINTING ARCHITECTURE USING IMAGE MARKING DEVICE MODULES," by Barry P. Mandel, et al;

U.S. patent application Ser. No. 10/953,953, filed Sep. 29, 2004, entitled "CUSTOMIZED SET POINT CONTROL FOR OUTPUT STABILITY IN A TIPP ARCHITECTURE," by Charles A. Radulski et al.;

U.S. application Ser. No. 10/999,326, filed Nov. 30, 2004, entitled "SEMI-AUTOMATIC IMAGE QUALITY ADJUSTMENT FOR MULTIPLE MARKING ENGINE SYSTEMS," by Robert E. Grace, et al.;

U.S. patent application Ser. No. 10/999,450, filed Nov. 30, 2004, entitled "ADDRESSABLE FUSING FOR AN INTEGRATED PRINTING SYSTEM," by Robert M. Lofthus, et al.;

U.S. patent application Ser. No. 11/000,158, filed Nov. 30, 2004, entitled "GLOSSING SYSTEM FOR USE IN A TIPP ARCHITECTURE," by Bryan J. Roof;

U.S. patent application Ser. No. 11/000,168, filed Nov. 30, 2004, entitled "ADDRESSABLE FUSING AND HEATING METHODS AND APPARATUS," by David K. Biegelsen, et al.;

U.S. patent application Ser. No. 11/000,258, filed Nov. 30, 2004, entitled "GLOSSING SYSTEM FOR USE IN A TIPP ARCHITECTURE," by Bryan J. Roof;

U.S. application Ser. No. 11/001,890, filed Dec. 2, 2004, entitled "HIGH RATE PRINT MERGING AND FINISHING SYSTEM FOR PARALLEL PRINTING," by Robert M. Lofthus, et al.;

U.S. application Ser. No. 11/002,528, filed Dec. 2, 2004, entitled "HIGH RATE PRINT MERGING AND FINISHING SYSTEM FOR PARALLEL PRINTING," by Robert M. Lofthus, et al.;

U.S. application Ser. No. 11/051,817, filed Feb. 4, 2005, entitled "PRINTING SYSTEMS," by Steven R. Moore, et al.;

U.S. application Ser. No. 11/069,020, filed Feb. 28, 2005, entitled "PRINTING SYSTEMS," by Robert M. Lofthus, et al.;

U.S. application Ser. No. 11/070,681, filed Mar. 2, 2005, entitled "GRAY BALANCE FOR A PRINTING SYSTEM OF MULTIPLE MARKING ENGINES," by R. Enrique Viturro, et al.; and, U.S. application Ser. No. 11/081,473, filed Mar. 16, 2005, entitled "MULTI-PURPOSE MEDIA TRANSPORT HAVING INTEGRAL IMAGE QUALITY SENSING CAPABILITY," by Steven R. Moore.

BACKGROUND

The present exemplary embodiment relates generally to fusing of images in a printing system including a plurality of marking engines. It finds particular application in conjunction with a printing system which includes first and second tandem marking engines where the second marking engine receives print media which has been preheated by the fuser of the first marking engine, and will be described with particular reference thereto. However, it is to be appreciated that the present exemplary embodiment is also amenable to other like applications.

In a typical xerographic marking engine, such as a copier or printer, a photoconductive insulating member is charged to a uniform potential and thereafter exposed to a light image of an original document to be reproduced. The exposure discharges the photoconductive insulating surface in exposed or background areas and creates an electrostatic latent image on the member, which corresponds to the image areas contained within the document. Subsequently, the electrostatic latent image on the photoconductive insulating surface is made visible by developing the image with a developing material. Generally, the developing material comprises toner particles adhering triboelectrically to carrier granules. The developed image is subsequently transferred to a print medium, such as a sheet of paper. The fusing of the toner onto the paper is generally accomplished by applying heat to the toner with a heated roller and application of pressure.

The reliability of fusers, and in particular, fusers for color marking engines, tends to be low when compared with the other components of a printing machine. This is primarily due to high temperatures and material strains and stresses employed in forming a long dwell time in the nip. To achieve a high gloss at reasonable temperatures in color applications, the surface smoothness (Ra) is generally about 0.4 microns or less. Over time, the color fuser roll tends to wear, resulting in non-uniformities in the surface of the roll, which, in turn, lead to gloss non-uniformities. Additionally, the lifetime of the fuser roll material is limited by the desire to provide compressibility to achieve an adequate nip width, which affects the dwell time for heating, and provide sufficient differential speeds to enable stripping and release.

Systems which incorporate several marking engines have been developed. These systems enable high overall outputs to be achieved by printing portions of the same document on multiple printers. Such systems are commonly referred to as "tandem engine" printers, "parallel" printers, or "cluster printing" (in which an electronic print job may be split up for distributed higher productivity printing by different printers, such as separate printing of the color and monochrome pages). In some systems, a process known as "tandem duplex printing" is employed. In this process, a first marking engine applies an image to a first side of a sheet and a second marking engine applies an image to a second side of the sheet. Each of the marking engines is thus operating in a simplex mode to generate a duplex print. This has been found to be more efficient for some applications than using a single marking engine with an internal duplex path to create a duplex print.

Such integrated printing systems have multiple fusers since each marking engine incorporates the fuser or fusers appropriate for fusing the images applied by that particular marking engine. As a result, the reliability of the individual fusers has a significant impact on overall reliability, since any one fuser failure can affect the productivity of the entire system.

BRIEF DESCRIPTION

Aspects of the present disclosure in embodiments thereof include a printing system and a method of printing. A xerographic printing system may include first and second marking engines. A first fuser is associated with the first marking engine for fusing images applied by the first marking engine to print media. A second fuser is associated with the second marking engine for fusing images applied by the second marking engine to print media. The printing system has a first mode of operation in which print media is fused by the first fuser and then by the second fuser and a second mode of operation in which at least a portion of the print media is fused by the second fuser, which portion has not been previously fused by the first fuser. The second fuser has a first fuser operating mode when the printing system is in the first mode of operation and a second fuser operating mode, when the printing system is in the second mode of operation. The second fuser applies a first energy input to the print media in the first fuser operating mode and a second energy input, different from the first energy input, to the print media in the second fuser operating mode.

In another aspect, a printing system may include a plurality of marking engines which apply images to print media, at least one of the marking engines selectively receiving print media which has been imaged and fused by at least one other of the plurality of marking engines. A fuser is associated with the first marking engine for fusing images applied by the first marking engine to print media. A control system accommodates for differences in print media input temperature arising from prior fusing of the print media, by adjusting an operating temperature of the fuser.

The method of printing may include, in a first mode of operation, forming an image on a sheet of print media in a first marking engine and fusing the image formed in the first marking engine with a first fuser associated with the first marking engine, conveying the imaged and fused sheet of print media to a second marking engine, forming an image on the imaged and fused sheet of print media in the second marking engine, and fusing the image formed in the second marking engine with a second fuser associated with the second marking engine, operating parameters of the first and second fusers being selected to account for differences in input temperature of the print media to the first and second fusers.

DETAILED DESCRIPTION

Figure 1:
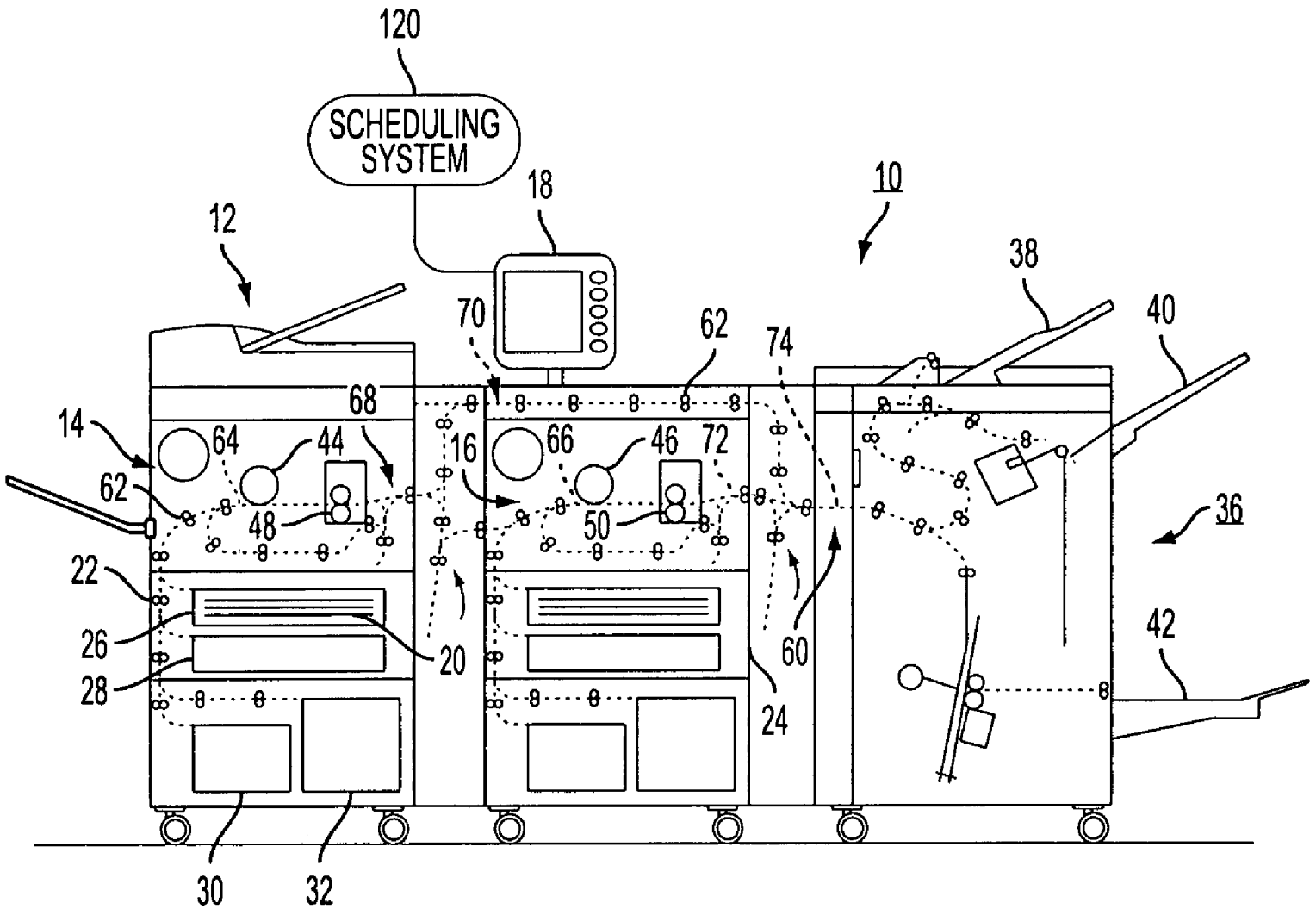
FIG. 1 is a side sectional view of a first embodiment of an exemplary printing system.

Aspects of the present disclosure in embodiments thereof relate to a printing system including multiple marking engines. The printing system may have an operating mode for tandem printing in which a sheet of print media is conveyed through the printing system and has images applied to the sheet by first and second marking engines, the second marking engine receiving the sheet from the first marking engine. Due to the fusing of an image in the first marking engine, the sheet may arrive at the second marking engine partially preheated. This excess heat can be taken into account in determining appropriate fusing parameters, such as an appropriate fuser temperature, for the second marking engine. The operating mode thus described has several advantages.

First, a fuser in the second marking engine may run at a lower temperature than would be the case when the paper is not preheated by a prior marking engine, improving the lifetime and reliability of the fuser in the second marking engine. The effect of decreasing the temperature of a fusing member, such as a fuser roll has a marked improvement in the member's life. Operating at a lower temperature results in the fusing member materials having an increased strength and slows the chemical reactions that result in fusing member failure modes, such as elastomer hardening and toner offset.

Another benefit is that there is less thermal energy imparted to the sheet by the second marking engine fuser, which could otherwise cause damage to post fuser components, such as baffles. Further, when the fuser temperature is lowered to take into account the incoming paper temperature, less excess heat needs to be removed from other system components for jam clearance and from the paper itself to prevent blocking. The baffles may have a preset maximum paper temperature for jam clearance of, for example, 40° C. The difference between the preset temperature and the actual temperature represents the excess heat to be removed. Thus, as the sheet output temperature increases, the greater the excess temperature there is to be removed to ensure jam clearance. Blocking or bricking occurs in the output tray. It arises from the pressure created by the stacking of multiple sheets and the elevated temperature of the sheets, which ultimately fuses the sheets together.

A further advantage is that higher levels of consistency can be achieved between images applied by the first and second marking engines. Appearance characteristics, such as gloss, tend to be dependent on the toner temperature achieved during fusing. The fusing temperature is a function of both the fuser member temperature and the temperature of the incoming sheet. At higher fusing temperatures/energy levels, the level of gloss tends to increase. A preheated sheet will be subjected to a higher total energy and thus a higher gloss may be achieved than for an unheated sheet. By adjusting the fuser member temperature to account for the incoming paper temperature, the gloss level of the image is more consistent with that generated by a marking engine (which may be the same or a different engine) receiving unheated paper.

In one embodiment, the fuser member temperature for the second printer is adjusted to provide a consistent print media surface output temperature. For example, the output temperature of the surface of printed media exiting from the nip of the first marking engine may be within 10° C. of the output temperature of the printed media from the second marking engine. In one embodiment, the outputs are within 5° C. of each other, and in another embodiment, within about 2° C. or 1° C. of each other. By comparison, the paper output temperatures of the two marking engines, where no accommodation is made for paper input temperature, may vary by about 20° C., or more. The temperatures can be selected such that the fusing provides at least a minimum acceptable level of fixing. Expressed in terms of the temperature variation of the print media where both fusers are set at the same temperature (i.e., when no account is taken of incoming print media temperature at the second fuser), when the second fuser temperature is controlled to account for the input print media temperature, the variation between the print media output temperatures of the first and second fusers may be 50% of that where the fusers are run at the same temperature. In one embodiment, the print media output temperature variation is less than about 25%, and in one specific embodiment, less than about 10%, of the variation where no account for input temperature is made.

As an alternative to adjusting the fuser temperature to account for preheated paper, other fusing parameters, or a combination of fusing parameters, may be modified to achieve consistent fusing. For example, at higher incoming paper temperatures, the dwell time (the time the paper spends in the nip) may be reduced, for example, by increasing the rotation speed of the fuser member. While particular reference is made herein to lowering the fuser member temperature for preheated sheets, it is to be appreciated that other fusing parameters may alternatively or additionally be adjusted. In one embodiment, the total heat energy E of a sheet exiting a fuser is kept constant where:

$$E=E_{paper}+E_{fuser}$$

where $E_{paper}$ is the incoming energy of the paper and is a function of the weight of the paper sheet and its temperature (in degrees Kelvin, K) and $E_{fuser}$ is a function of the fuser member temperature (in K) and the dwell time.

While the system will be described with particular reference to tandem duplex printing, it will be appreciated that rather than applying an image to an opposite side of a sheet to the image applied by the first marking engine, the second marking engine may apply an image to the same side of the sheet as the first marking engine.

Exemplary printing systems include light-lens copiers, digital printers, facsimile machines, and multifunction devices, and can create images electrostatographically, by ink-jet, hot-melt, or by another suitable method.

Each of the marking engines includes an image-forming component capable of forming an image on print media. Particular reference is made herein to a xerographic printing system in which the marking engines each include a photoconductive insulating member which is charged to a uniform potential and thereafter exposed to a light image of an original document to be reproduced. The exposure discharges the photoconductive insulating surface in exposed or background areas and creates an electrostatic latent image on the member, which corresponds to the image areas contained within the document. Subsequently, the electrostatic latent image on the photoconductive insulating surface is made visible by developing the image with an imaging material such as a developing powder comprising toner particles. The toner image may subsequently be transferred to the print media, to which it is permanently affixed in the fusing process. In a multicolor electrophotographic process, successive latent images corresponding to different colors are formed on the insulating member and developed with a respective toner of a complementary color. Each single color toner image is successively transferred to the paper sheet in superimposed registration with the prior toner image to create a multi-layered toner image on the paper. The superimposed images may be fused contemporaneously, in a single fusing process. It will be appreciated that other suitable processes for applying an image may be employed, which result in the print media being heated in the first marking engine.

The fuser receives the imaged print media from the image-forming component and fixes the toner image transferred to the surface of the print media substrate. The fusers employed in the marking devices can be of any suitable type, and may include fusers which apply heat or both heat and pressure to an image. For example, the fuser may apply one or more of heat or other forms of electromagnetic radiation, pressure, electrostatic charges, and sound waves, to form a copy or print. One suitable fuser includes a pair of rotating rollers spaced to define a nip through which the print media is fed. One of the rollers is heated, while the other roller may serve simply as a means of applying pressure. Other fusing members are also contemplated in place of a pair of rollers, such as belts, sleeves, drumbelts, and the like. Other suitable fusers which may be employed include radiant fusers, which apply a high-intensity flash lamp to the toner and paper.

The process of fusing generally results in an attachment of an applied image to the print media substrate by at least partial melting of an imaging material, such as toner particles. The fusing process may also influence the appearance of the applied image, for example, by modifying the level of gloss of the image.

The terms "marking engine" and "printer," are used interchangeably to refer to a device for applying an image to print media. "Print media" can be a usually flimsy physical sheet of paper, plastic, or other suitable physical print media substrate for images, whether precut or web fed. The printing system may include a variety of other components, such as finishers, paper feeders, and the like, and may be embodied as a copier, printer, or a multifunction machine. A "print job" or "document" is normally a set of related sheets, usually one or more collated copy. sets copied from a set of original print job sheets or electronic document page images, from a particular user, or otherwise related.

The printing system may incorporate "tandem engine" printers, "parallel" printers, "cluster printing," "output merger," or "interposer" systems, and the like, as disclosed, for example, in U.S. Pat. Nos. 4,579,446; 4,587,532; 5,489,969 5,568,246; 5,570,172; 5,596,416; 5,995,721; 6,554,276, 6,654,136; 6,607,320, and in above-mentioned application Ser. Nos. 10/924,459 and 10/917,768, the disclosures of which are totally incorporated herein by reference. A parallel printing system feeds paper from a common paper stream to a plurality of printers, which may be horizontally and/or vertically stacked. Printed media from the various printers is then taken from the printer to a finisher where the sheets associated with a single print job are assembled. Variable vertical level, rather than horizontal, input and output sheet path interface connections may be employed, as disclosed, for example, in U.S. Pat. No. 5,326,093 to Sollitt.

With reference to FIG. 1, an exemplary printing system 10 is shown. The printing system includes an image input device 12, a plurality of marking engines 14, 16, and a common control system 18, all interconnected by links. The marking engines are operatively connected, via the control system, for printing images from a common print job stream provided by the image input device. The links can be a wired or wireless link or other means capable of supplying electronic data to and/or from the connected elements. Exemplary links include telephone lines, computer cables, ISDN lines, and the like. The image input device 12 is illustrated as a scanner 12, although other image input devices are also contemplated, such as a network server, which, in turn, may be linked to one or more workstations, such as personal computers. The image input device 12 may include conversion electronics for converting the image-bearing documents to image signals or pixels or this function may be assumed by the marking engines.

While the illustrated embodiment shows two marking engines 14, 16, it will be appreciated that the printing system may include more than two marking engines, such as three, four, six, or eight marking engines. The marking engines may be electrophotographic printers, ink-jet printers, including solid ink printers, and other devices capable of marking an image on a substrate. The marking engines can be of the same print modality (e.g., process color (P), custom color (C), black (K), or magnetic ink character recognition (MICR)) or of different print modalities. The marking engines all communicate with the control system.

The marking engines 14, 16 are fed with print media 20 from a respective print media source 22, 24, such as a paper feeder, herein illustrated as including a plurality of paper trays 26, 28, 30, 32. Alternatively, both marking engines can be fed with print media from a common source. Printed media from the marking engines is delivered to a common output destination, such as a finisher 36, herein illustrated as including a plurality of output trays 38, 40, 42. The marking engines 14, 16 each include an imaging component 44, 46, and an associated fuser 48, 50, respectively.

A print media transporting system 60 links the print media sources 22, 24, printers 14, 16, and finisher 38. The print media transporting system 60 includes a network of flexible paper pathways that feeds to and collects from each of the printers. The print media transporting system 60 may comprise drive members, such as pairs of rollers 62, spherical nips, air jets, or the like. The system 60 may further include associated motors for the drive members, belts, guide rods, frames, etc. (not shown), which, in combination with the drive members, serve to convey the print media along selected pathways at selected speeds. In the illustrated embodiment, print media from source 22 is delivered to printer 14 by a pathway 64 which is common to a plurality of the trays. In printer 14, the print media is printed by imaging component 44 and fused by fuser 48. Similarly, print media from source 24 is delivered to printer 16 by a pathway 66 where it is printed by imaging component 46 and fused by fuser 50. A pathway 68 transports media which has been printed and fused by printer 14 to printer 16 where it is further printed and fused. A bypass pathway 70 allows media printed by printer to bypass printer 16. The pathway 70 merges with an output pathway 72 from printer 16 into a common pathway 74 which conveys the printed media in a common stream to the finisher 36.

In the illustrated embodiment, printer 14 is upstream of printer 16 in that media can travel from printer 14 to printer 16 but not from printer 16 to printer 14. However it is to be appreciated that more elaborate printing systems can be arranged in which media printed by printer 16 can be directed to printer 14. It is also contemplated that there may be additional printers downstream of printer 16.

The pathways 64, 66, 68, 70, 72, 74 of the network 60 may include inverters, reverters, interposers, bypass pathways, and the like as known in the art to direct the print substrate between the highway and a selected printer or between two printers. It will be appreciated that the printers may be configured for duplex or simplex printing and that a single sheet of paper may be marked by two or more of the printers or marked a plurality of times by the same printer, for example, by providing internal duplex pathways.

Figure 2:
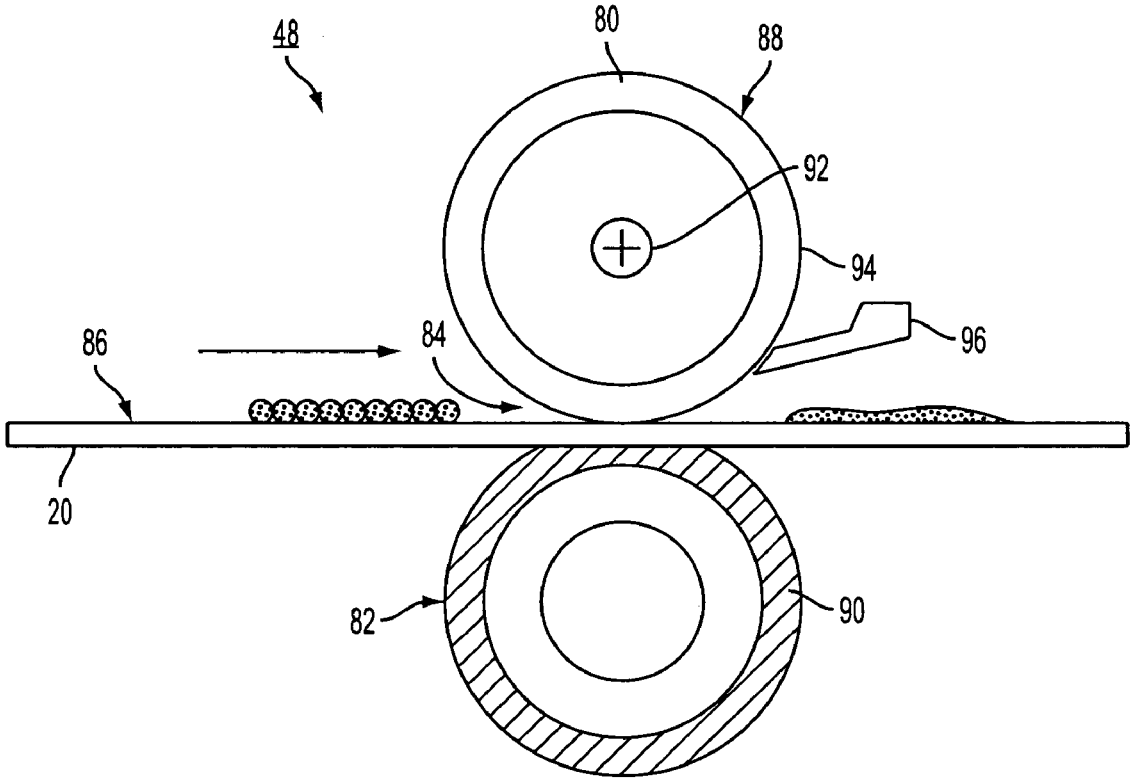
FIG. 2 is an enlarged view of the fuser of one of the marking engines of the printing system of FIG. 1.

FIG. 2 shows an exemplary fuser 48. Fuser 48 includes a fuser roll 80 and a pressure roll 82, which are spaced by a nip 84. The fuser roll faces the image side 86 of a sheet 20 and may have one or more elastomeric coatings 88. The pressure roll may have one or more elastomeric coatings 90. A heater 92 is axially located within the fuser roll 80 for heating the fuser roll surface 94 to a desired temperature. The heater may be controlled, for example, by varying the power supplied to the heater and thereby adjust the temperature at the fuser roll surface 94. A stripping assist 96 is located downstream of the nip to assist in separating the print media and fused toner from the fuser roll 80. Fuser 50 can be similarly configured.

The printing system 10 has a first mode of operation in which the temperature of a fuser is adjusted to accommodate a variation in temperature of incoming print media. In an illustrative embodiment, a particular job may include printer 14 feeding printer 16 with printed media which is preheated by the fuser 48. The fuser 50 can thus be set at a lower temperature than would normally be selected for achieving certain fusing characteristics, such as fixing and/or gloss level. Fuser 48, which does not receive preheated printed media, may thus be set at a higher operating temperature than fuser 50. In this mode, less heat is used by the system than would be the case where both fusers 48, 50 are set at the same operating temperature, e.g., at a temperature which is designed for achieving desired fusing characteristics assuming the print media is not preheated. It will be appreciated that, even where nominally the same, fusers may operate somewhat differently and thus may need to be set at different temperatures to achieve nominally the same fusing characteristics in terms of e.g., gloss and/or fixation.

Other jobs, such as simplex printing jobs, may entail bypassing printer 16 or parallel simplex printing, in which a portion of a print job is printed on one side by the first printer and a different portion is printed on one side by the second printer. For such jobs, the printing system 10 may have a second mode of operation in which there is no adjustment to accommodate for preheated print media. In this embodiment, both fusers can be set at the same operating temperature or at a temperature which is designed for achieving the same desired fusing characteristics assuming the print media is not preheated.

It will be appreciated that a system of more than two printers may involve different levels of preheating. For example, a sheet of printed media which has been successively printed by two printers may have a higher temperature on reaching a third printer than on reaching the second printer. Additionally, a fuser of one type of printer may cause greater heating than another, for example a color fuser (P or C) may heat the media to a greater temperature than a black only (K) printer. Further, the paper pathways between printers may result in different degrees of cooling of the printed media before reaching another printer. The first mode for the printing system may thus account for several different media input temperatures, depending on the printed media's provenance.

Figure 3:
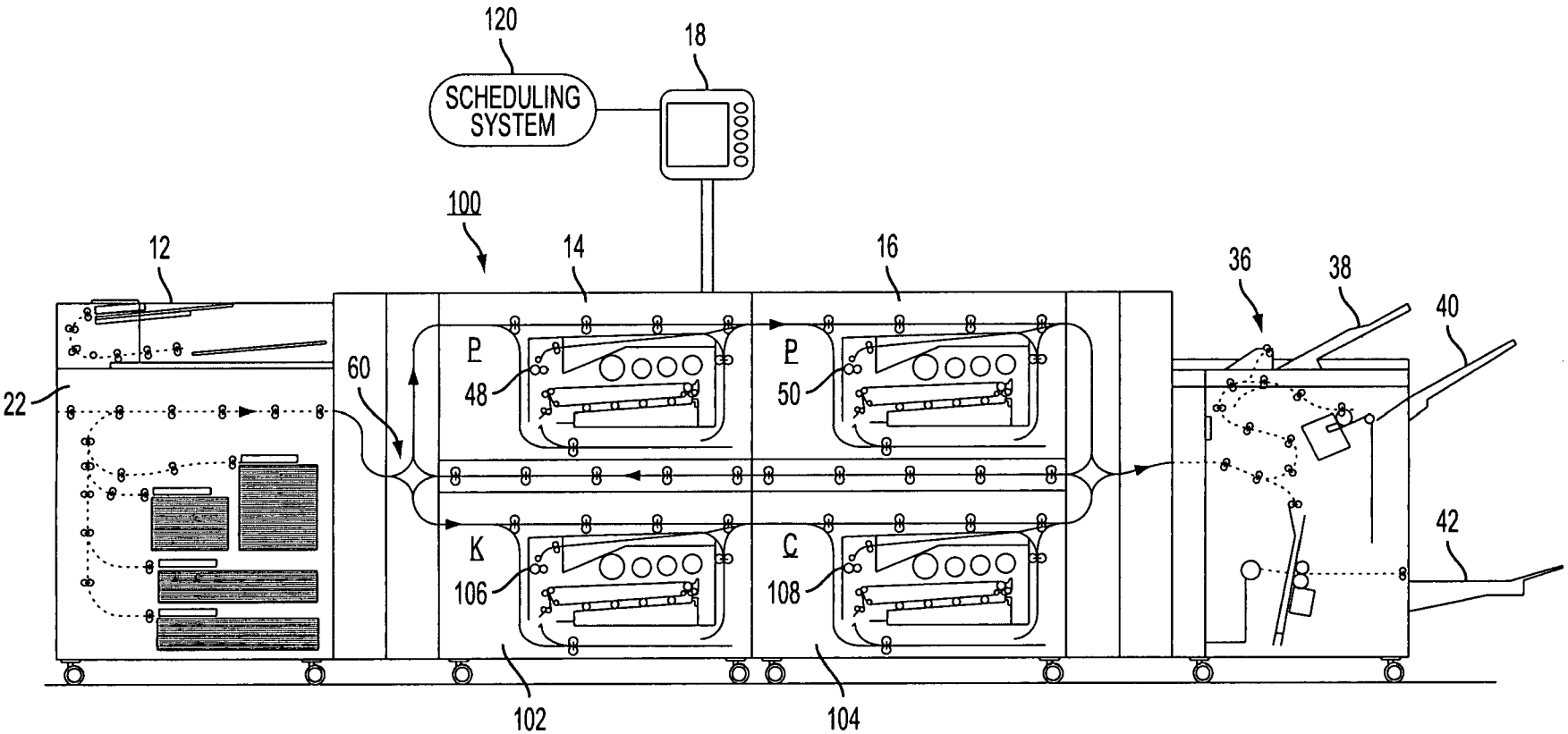
FIG. 3 is a side sectional view of a second embodiment of an exemplary printing system.

A printing system 100 exemplifying multiple printers and their pathways is shown in FIG. 3, where similar elements are accorded the same numerals. The system is similar to that of FIG. 1, except as otherwise noted. In this embodiment a plurality of printers 14, 16, 102, 104 receive print media from a common high speed paper feeder 22. Printers 14 and 16 may be process color (P) printers and printers 102, 104 may be of a different print modality or modalities, such as black (K) and custom color (C). Each printer 14, 16, 102, 104 has an associated fuser 48, 50, 106, 108. A network 60 of paper paths connects the printers. The network is constructed such that print media can travel from any printer to any other printer in the system by appropriate pathways and also bypass any of the printers en route to the finisher 36. Thus, for example, a sheet of print media may have side A printed by black printer 102, side A printed again by custom color printer 104, be inverted and have side B printed by process color printer 14. In this example, the print media reaches printer 102 without preheating, so the fuser 106 of printer 102 is run at a normal operating temperature without adjustment for an elevated paper temperature. The normal operating temperature of fuser 108 of printer 104 is adjusted downwardly to account for the incoming temperature of the paper caused by fusing in fuser 106. The adjustment will take into account the heat applied by both the fusers 106, 108 and any cooling of the sheet. As can be seen, the paper pathway between printers 104 and 14 is longer than that between printer 102 and printer 104, so additional cooling may be expected.

The optimal temperature adjustments to the fusers for providing consistent fuser temperatures and/or consistent appearance characteristics can be determined from computer models or experimentally, for example, by routing print media by different routes through the printing system and determining the temperature of the paper entering the fusers. Alternatively, or additionally, appearance measurements (such as gloss levels) can be made on the output sheets for a particular paper route and the fuser temperatures varied until consistent gloss levels are achieved between images. These fuser temperatures then become the new operating temperatures for the fuser when the same route is used again.

The computer processor 18 may include a look up table which includes appropriate fuser set points for each of the fusers for different operating modes.

It will be appreciated that a fuser roll has a finite time for adjustment, which may depend on the type of fuser and the extent of the temperature adjustment. For example, a fuser may take from a few seconds to several minutes to drop a few degrees Centigrade, depending on the thickness of the fuser roll and its composition. Thus, fuser roll adjustments are generally performed prior to printing of a print job in which a large number of pages, e.g., about 50 or more pages, is being printed using a given paper route. Where the print job is relatively small, for example 10 pages or less on the same paper route, it may not be practically feasible to perform an adjustment. Additionally, during a print job in which sheets are simultaneously following different routes, it may not be feasible to assign fuser roll adjustment temperatures which satisfy the demands of all of the routes. In such a case, a compromise adjustment may be made.

The printing system 10, 100 includes a scheduling system 120 associated with the control system, which schedules print jobs based on various constraints, such as optimizing the output of the printing system. Various methods of scheduling print media sheets may be employed. For example, U.S. Pat. No. 5,095,342 to Farrell, et al.; U.S. Pat. No. 5,159,395 to Farrell, et al.; U.S. Pat. No. 5,557,367 to Yang, et al.; U.S. Pat. No. 6,097,500 to Fromherz; and U.S. Pat. No. 6,618,167 to Shah; U.S. application Ser. Nos. 10/284,560; 10/284,561; and 10/424,322 to Fromherz, all of which are incorporated herein in their entireties by reference, disclose exemplary scheduling systems which can be used to schedule the print sequence herein, with suitable modifications.

The scheduling system 120 receives information about the print job or jobs to be performed and proposes an appropriate route for the print media to follow in each of the jobs. The scheduling system confirms with each of the system components, such as printers, inverters, etc. that they will be available to perform the desired function, such as printing, inversion, etc., at the designated future time, according to the proposed schedule. Once the route has been confirmed in this way, any fuser temperature modifications are determined by the control system 18 and the printers notified so the fusers will be at the appropriate temperature when the print media arrives. Where the scheduling system has multiple jobs waiting in a queue, the scheduling system may order the jobs in the queue to minimize the time needed for fuser roll adjustments.

Without intending to limit the scope of exemplary embodiments, the following examples demonstrate some of the benefits of adjustment of fusing parameters.

EXAMPLE 1

Figure 4:
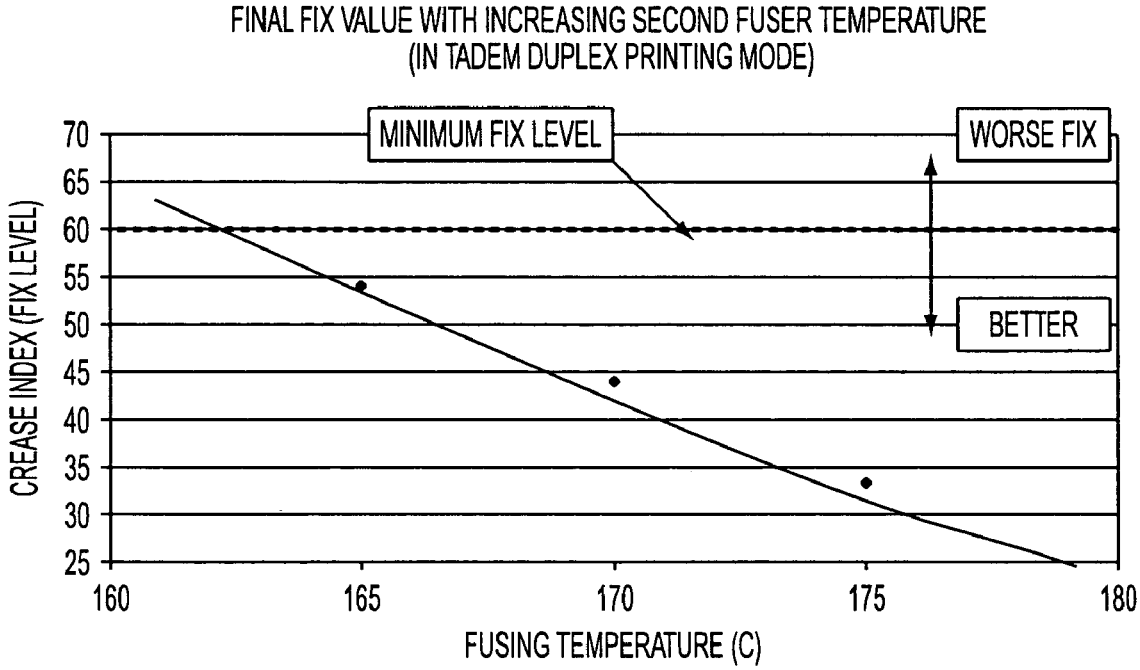
FIG. 4 is a plot of crease index vs. fusing temperature for the second fuser in a tandem duplex printing mode.

Productolith™ (270 gsm) coated stock is imaged and fused at different fuser temperatures and the crease area of a monochrome image is determined by forming a crease in the printed paper, brushing off the loose toner, and determining the area of toner which has been detached by the creasing (the "crease area"). Crease area values can be normalized to give a crease index. In general, the smaller the crease area or crease index, the better the fixation. FIG. 4 shows crease index versus fusing temperature. An acceptable crease index can be defined, 60 in the exemplary embodiment, and fusing temperatures which achieve this crease index or achieve a lower crease index are considered to be acceptable, at least as far as fixation is concerned. The results show that temperatures of around 163° C. or higher provide adequate fix for the second fuser of a printing system operating in duplex mode.

EXAMPLE 2

In the following two examples, the Case 1 demonstrates the case where the fusers of two marking engines (printer 1 and printer 2) are set to the same setpoints and Case 2 demonstrates the case where the fuser of the downstream marking engine (printer 2) is set to a lower temperature. Changes in paper temperature (ΔPaper Temp) as a result of the fusing operation are calculated by suitable software.

Case 1

Both Fuser Temps Set to 193° C.

Printer 1: For an initial paper temp=22° C.=295K and ΔPaper Temp=100K

Final Paper Temp=Initial Paper temp+ΔPaper Temp=395K=122° C.

Printer 2: For an initial paper temp=68° C.=341K and ΔPaper Temp=65K

Final Paper Temp=Initial Paper temp+ΔPaper Temp=406K=133° C.

The difference in output temperatures is thus 133-122=11° C.

Case 2

First Fuser Temp Set to 193° C. Second Fuser Temp Set to 164° C.

Printer 1 (as before)

Printer 2: For an initial paper temp=68° C.=341K and ΔPaper Temp=53K

Final Paper Temp=Initial Paper temp+ΔPaper Temp=394K=121° C.

It can be seen that if the second fuser is set at 164° C., roughly the same paper temperature outputs are achieved for the first and second fusers, when feeding room temperature sheets to the first fuser. As will be appreciated, this is for steady state conditions and there may be a period of adjustment time.

EXAMPLE 3

Figure 5:
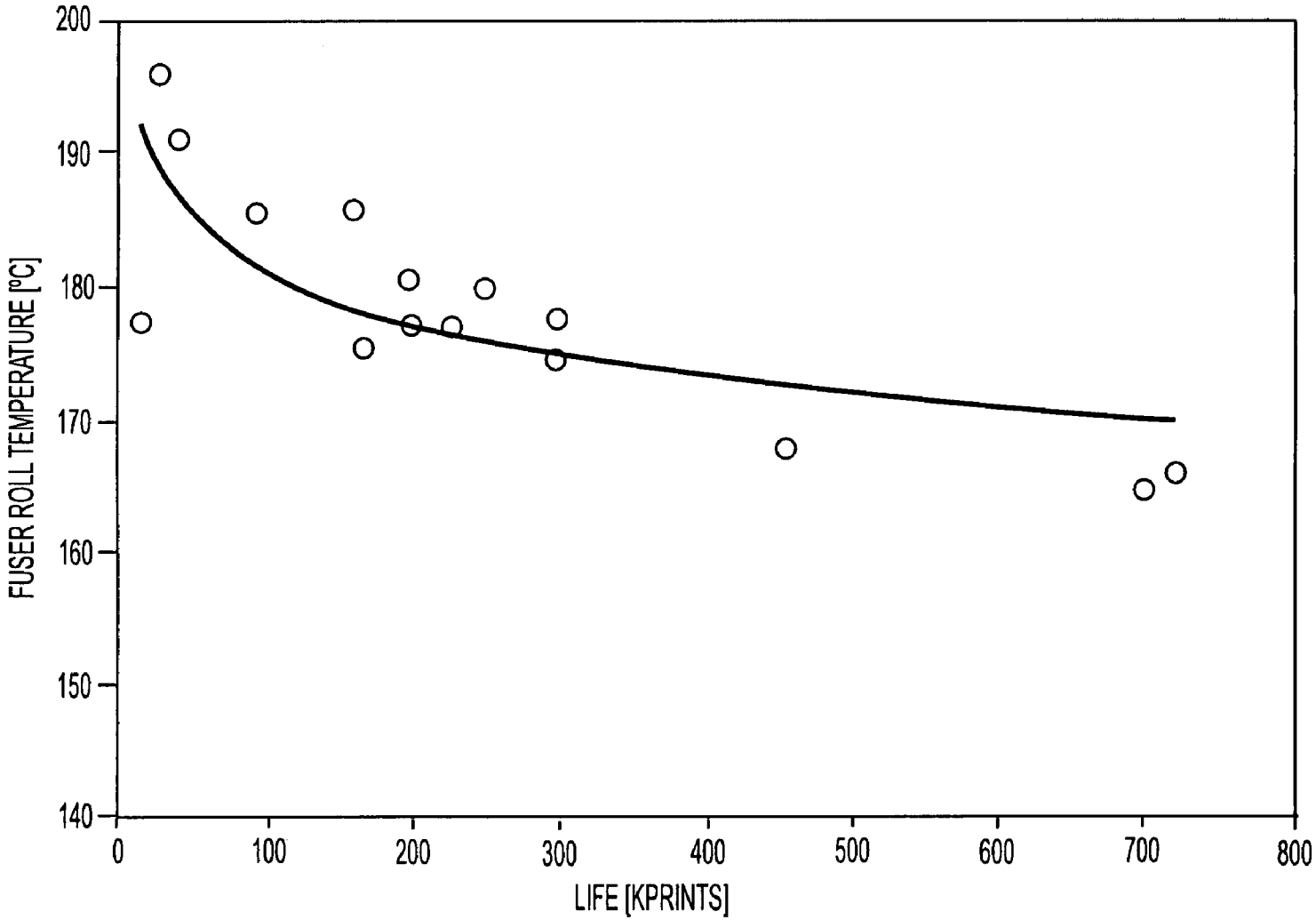
FIG. 5 is a plot of fuser life to failure for a representative printer measured in terms of the number of copies made, vs. the fuser roll temperature (° C.) and crease area vs. belt temperature for printed media with and without preheating.

FIG. 5 shows fuser life before failure for a representative fuser measured in terms of the number of copies made, vs. the fuser roll temperature (° C.). As can be seen from FIG. 5, the lifetime increases significantly as the fuser roll temperature is lowered.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A xerographic printing system comprising:

a first marking engine;

a first fuser associated with the first marking engine for fusing images applied by the first marking engine to print media;

a second marking engine;

a second fuser associated with the second marking engine for fusing images applied by the second marking engine to print media;

the printing system having a first mode of operation in which print media is fused by the first fuser and then by the second fuser and a second mode of operation in which at least a portion of the print media is fused by the second fuser, which portion has not been previously fused by the first fuser, the second fuser having a first fuser operating mode when the printing system is in the first mode of operation and a second fuser operating mode, when the printing system is in the second mode of operation, the second fuser applying a first energy input to the print media in the first fuser operating mode and a second energy input, different from the first energy input, to the print media in the second fuser operating mode.

2. The printing system of claim 1, wherein the first energy input is lower than the second energy input.

3. The printing system of claim 1, further comprising:

a print media transporting system which conveys print media between the first and second printers.

4. The printing system of claim 2 wherein the print media transporting system includes a bypass pathway in which print media imaged by the first marking engine bypasses the second marking engine.

5. The printing system of claim 1, further comprising:

a finisher which receives print media from the first and second printers.

6. The printing system of claim 1, wherein, in the first mode of operation, output temperatures of print media from the first and second fusers are consistent.

7. The printing system of claim 1, wherein, in the first mode of operation, the output temperature of print media from the first fuser is within about 10° C. of the output temperature of print media from the second fuser.

8. The printing system of claim 7, wherein, in the first mode of operation, the output temperature of print media from the first fuser is within about 5° C. of the output temperature of print media from the second fuser.

9. The printing system of claim 1, wherein, in the first mode of operation, the difference between the output temperature of print media from the first fuser and the output temperature of print media from the second fuser is less than 50% of the difference between the output temperature of print media from the first fuser and the output temperature of print media from the second fuser in the second mode of operation.

10. The printing system of claim 1, wherein in the first fuser operating mode, the second fuser has a lower operating temperature than in the second fuser operating mode.

11. The printing system of claim 1, further comprising a scheduling system which schedules printing of print jobs and computer implemented means for adjusting an operating temperature of the second fuser according to whether the scheduling system schedules a print job according to the first operating mode or the second operating mode.

12. The printing system of claim 1, further comprising a third marking engine and a third fuser associated with the third marking engine and wherein the printing system has a third mode of operation in which print media is fused by the first and second fusers and then by the third fuser, and a fourth mode of operation in which the print media is fused by fewer than all of the first and second fusers, the third fuser having a first operating mode when the printing system is in the first mode of operation and at least a second operating mode, when the printing system is in the second mode of operation, the second fuser applying more energy to the print media in the second operating mode than in the first operating mode.

13. The printing system of claim 1, wherein in the second mode of operation, a second portion of the print media is fused by the first fuser but not by the second fuser.

14. The printing system of claim 1, further comprising a control system which recognizes when the printing system is about to change its mode of operation from operating in one of the first and second modes of operation to operating in the other of the first and second modes of operation and adjusts an energy input to the second fuser.

15. A printing system comprising:

a plurality of marking engines which apply images to print media, at least a first of the marking engines selectively receiving print media which has been imaged by at least one other of the plurality of marking engines, a fuser associated with the first marking engine for fusing images applied by the first marking engine to print media; and a control system which accommodates for differences in print media input temperature arising from prior fusing of the print media, by adjusting an operating temperature of the fuser.

16. The printing system of claim 15, wherein the control system adjusts the operating temperature of the fuser to maintain a consistent output temperature of print media from the first marking engine.

17. The printing system of claim 15, wherein the control system adjusts the operating temperature of the fuser as a function of the input temperature of the print media.

18. The printing system of claim 15, wherein the computer implemented means includes a look up table which associates a first operating temperature with a first route of print media through the printing system to the second printer and a second operating temperature with a second route of print media through the printing system to the second printer.

19. A method of printing comprising:

in a first mode of operation:

forming an image on a sheet of print media in a first marking engine;

fusing the image formed in the first marking engine with a first fuser associated with the first marking engine;

conveying the imaged and fused sheet of print media to a second marking engine;

forming an image on the imaged and fused sheet of print media in the second marking engine; and fusing the image formed in the second marking engine with a second fuser associated with the second marking engine, operating parameters of the first and second fusers being selected to account for differences in input temperature of the print media to the first and second fusers.

20. The method of printing of claim 19, further comprising:

in a second mode of operation:

forming an image on a sheet of print media in the second marking engine;

fusing the image formed in the first marking engine with a first fuser associated with the first marking engine;

conveying the imaged and fused sheet of print media to a second marking engine;

forming an image on the imaged and fused sheet of print media in the second marking engine; and fusing the image formed in the second marking engine with a second fuser associated with the second marking engine, operating parameters of the first and second fusers being selected to account for differences in input temperature of the print media to the first and second fusers.

21. The method of printing of claim 19, further comprising:

controlling the second fuser such that the print media output from the second fuser is at a temperature which is within about 5° C. of the temperature of the print media output from the first fuser.

* * * * *